US010814515B2

(12) United States Patent
Strandh et al.

(10) Patent No.: US 10,814,515 B2
(45) Date of Patent: Oct. 27, 2020

(54) METHOD AND APPARATUS FOR TRIMMING CORES

(71) Applicant: Core Link AB, Falkenberg (SE)

(72) Inventors: Nils Strandh, Gullbrandstorp (SE); Jörgen Jensen, Ullared (SE)

(73) Assignee: Core Link AB, Falkenberg (SE)

( * ) Notice: Subject to any disclaimer, the term of this patent is extended or adjusted under 35 U.S.C. 154(b) by 0 days.

(21) Appl. No.: 15/422,949

(22) Filed: Feb. 2, 2017

(65) Prior Publication Data

US 2017/0217039 A1 Aug. 3, 2017

(30) Foreign Application Priority Data

Feb. 3, 2016 (SE) ..... 1650131

(51) Int. Cl.

| | |
|---|---|
| ***B26D 3/16*** | (2006.01) |
| ***B26D 7/02*** | (2006.01) |
| ***B26D 5/00*** | (2006.01) |
| ***B26D 7/18*** | (2006.01) |
| *B26D 1/157* | (2006.01) |

(Continued)

(52) U.S. Cl.

CPC ..... *B26D 3/166* (2013.01); *B26D 5/005* (2013.01); *B26D 7/025* (2013.01); *B26D 7/18* (2013.01); *B26D 1/157* (2013.01); *B26D 2007/0018* (2013.01); *B26D 2007/013* (2013.01)

(58) Field of Classification Search

CPC ..... B26D 1/157; B26D 2007/0018; B26D 2007/013; B26D 3/166; B26D 5/005; B26D 7/025; B26D 7/18

USPC ..... 83/13, 27, 54, 183; 264/159; 82/47, 82/101, 70.2, 113

See application file for complete search history.

(56) References Cited

U.S. PATENT DOCUMENTS 3,673,299 A * 6/1972 Robins ..... B26D 3/16 264/159
3,791,652 A * 2/1974 Schuler ..... A63B 57/207 473/286

(Continued)

FOREIGN PATENT DOCUMENTS

JP 2004230518 A 8/2004
SE 518440 C2 8/2001

(Continued)

OTHER PUBLICATIONS

Search Report from ITS/SE16/00110 dated Sep. 5, 2016.

(Continued)

*Primary Examiner* — Ghassem Alie
(74) *Attorney, Agent, or Firm* — Calfee Halter & Griswold LLP

(57) ABSTRACT

A core end piece collector for handling cut off end pieces during processing of tubular cores with a hollow centre portion includes a carrying member. At least a portion of the carrying member is configured to be arranged inside of a core during cutting of the core. The collector further includes a catcher being arranged on the carrying member, said catcher protruding from the carrying member at an angle in relation to the longitudinal direction of said carrying member such that the catcher is insertable into a cut in the core. The core end piece collector further comprises means for moving at least the carrying member in relation to the core.

7 Claims, 5 Drawing Sheets

(51) Int. Cl.
*B26D 7/00* (2006.01)
*B26D 7/01* (2006.01)

(56) References Cited

U.S. PATENT DOCUMENTS 3,844,188 A * 10/1974 Williams ..... B23D 31/00 83/188
3,911,557 A * 10/1975 Pierce ..... B29C 51/445 29/33 A
3,911,768 A 10/1975 Kawano
4,517,867 A * 5/1985 Fuminier ..... B23D 21/00 30/94
4,549,678 A * 10/1985 Fuminier ..... B23D 21/00 225/2
4,930,379 A * 6/1990 Takaniemi ..... B26D 3/16 82/101
4,987,808 A * 1/1991 Sicka ..... B26D 3/16 269/156
5,170,684 A * 12/1992 Lofstrom ..... B23D 21/00 82/101
5,383,380 A 1/1995 Sartori
6,427,566 B1 * 8/2002 Jones ..... H01L 21/67046 15/88.3
6,752,055 B2 * 6/2004 Borzym ..... B23D 21/14 83/161
7,137,435 B2 * 11/2006 Fujikawa ..... B22D 17/10 164/312
7,383,757 B2 * 6/2008 Maier ..... B23B 5/162 82/1.11
7,640,834 B2 * 1/2010 Morawiec ..... B26D 3/166 82/101
7,800,283 B2 * 9/2010 Kawano ..... B23P 19/06 310/323.12
8,026,458 B2 * 9/2011 Widmann ..... B23K 26/0823 219/121.67
8,677,603 B1 * 3/2014 Reynolds ..... A01G 23/10 29/237
2007/0028732 A1 2/2007 Morawiec et al.
2010/0199820 A1 8/2010 Quigley
2011/0308881 A1 * 12/2011 Cappuccio ..... G05G 1/54 180/320

FOREIGN PATENT DOCUMENTS

TW 200603859 2/2006
WO 2013017987 A1 2/2013
WO 2017133756 8/2017

OTHER PUBLICATIONS

E Appleton et al: "Industrial Robot Applications" In: "Industrial Robot Applications", Dec. 31, 1987 (Dec. 31, 1987), Open University Press, XP55701913, ISBN: 978-0-335-15406-7 pp. 58-67 and 182.

* cited by examiner

METHOD AND APPARATUS FOR TRIMMING CORES

CROSS-REFERENCE TO RELATED APPLICATIONS

This application claims priority to Swedish Patent Application No. 1650131-4 filed on Feb. 3, 2016, the contents of which are hereby incorporated by reference as if recited in their entirety.

TECHNICAL FIELD

The present invention relates to a method for collecting cut off core end pieces, an apparatus for collecting end pieces and an apparatus for processing cores. More specifically, the invention concerns a core end piece collector and a core processing apparatus comprising a core end piece collector. Related art is reflected for instance by the document WO2013017987A1.

BACKGROUND

In the material handling industry, it is common to use tubular, hollow cores as support for wound sheet materials such as paper, foils and the like. Usually, the material is wound onto either a shaft or a core in a production/winding station and then delivered to a converting station where the material is unwound and cut into the dimensions which are desired for the product at hand.

Today, new cores are often used for transporting the converted material. In order to be able to reuse the old cores for the converted material, it is often necessary to process the core, cutting it into sections with a length which matches the width of the converted material. It is beneficial to reuse the cores for several reasons, two examples being the high costs of procuring new cores and the negative environmental impact of having to discard the used cores.

When cutting cores into sections adapted for the converted material, at least one of the cut off end pieces of the core often needs to be discarded. It is desired to reduce the size of the discarded end piece. This is however limited by the fact that many automated core processing machines for instance rely on the ability of the end piece to be able to roll off the processing station or for other reasons have difficulties handling end pieces with small widths. This results in that the end piece needs to have a certain size for avoiding processing malfunctions, which means that large amounts of core material is wasted due to the limitations of the core processing machines of today.

SUMMARY

It is therefore an object of the teachings herein to provide an improved method and an end piece collector which alleviates some of the problems with prior art. It is also an object of the teachings to provide a core processing apparatus which can reduce the size of core end pieces. These objects and other objects which will appear in the following, have now been achieved by a concept which is improved over prior art and which is set forth in the appended independent claims; preferred embodiments thereof being defined in the related dependent claims.

In a first aspect of the teachings herein, there is provided a method for processing cores having tubular shape with hollow centre portions. The method comprises the steps of: moving at least a portion of a carrying member of a core end piece collector inside the core centre portion; inserting the catcher into a cut made by a core cutting member, whereby the catcher restricts a cut off core end piece from falling of the carrying member. The end piece of the core is thereby stabilized during the cutting or trimming process and the need for roll stability of the end piece is removed which allows reduction of the size of the end piece. The risk of core end pieces ending up jamming the process of cutting cores is thus reduced.

In an embodiment of the teachings herein, the collector is configured to place cut off core end pieces in an end piece collection position. The collector can thereby place the cut off core end pieces, one or more at a time, in a controlled manner in a collection position such as a container or on a conveyor.

In one embodiment, the core is rotated during cutting, and the catcher is inserted into the cut made by the core cutting member during cutting before the entire circumference of the core is cut. The end piece will thereby be collected as soon as it is cut loose from the rest of the core and is secured by the catcher such that is does not fall off the carrying member.

In another embodiment, at least a portion of the carrying member is firstly moved inside the core centre portion during processing of the core such that the catcher arranged on the carrying member is aligned with a cutting plane of the core cutting member and then moved in a direction in the cutting plane until a portion of the core end piece collector is in the vicinity of an inner surface of the core. In this way, the core is not damaged by the carrying member or the catcher during the rotation of the core.

In an alternative embodiment, at least a portion of the carrying member is firstly moved inside the core centre portion during processing of the core such that the catcher arranged on the carrying member is aligned with the cutting plane of the core cutting member and then moved in a direction in the cutting plane until a portion of the core end piece collector is in contact with an inner surface of the core.

In one embodiment, the axial direction of the core is essentially horizontally oriented during processing and the core end piece collector is configured to place the carrying member at or in the vicinity of the highest located portion of the core centre portion before it inserts the catcher into the cut. The end piece is in this manner kept from swinging when it is collected by the carrying member.

In yet another embodiment of the teachings herein, the catcher is inserted into the cut by rotating at least the carrying member around the longitudinal axis of said carrying member such that the catcher is rotated into the cut made by the cutting member. The rotating motion may provide a more accurate way of inserting the catch member into the cut made by the cutting member.

The core end piece collector may release the end piece of the core in an end piece collection position by lowering the end piece onto an uneven and/or leaning surface such that it falls of the core end piece collector. The end piece is lifted over the catcher and falls in a controlled manner into the collection position.

In an alternative embodiment, the core end piece collector releases the end piece of the core in an end piece collection position by firstly rotating at least the carrying member around the longitudinal axis of the carrying member such that the catcher does not obstruct axial motion of the end piece and then tilting at least the carrying member such that the end piece slides off.

The core end piece collector may detect a contact force between a portion of the core end piece collector and the inner surface of the core during movement of the carrying member towards the inner surface of the core, and a contact force above a threshold value indicates sufficient contact between the core end piece collector and the core. The collector is thereby able to ensure sufficient contact and correct placement of the carrying member even if the core is for instance deformed for some reason or has a shape which is other than what is expected.

Preferably, the core end piece collector clamps the end piece by means of a clamping element which applies a pressure on the end piece such that it is held in place between the catcher and the clamping element, the clamping being performed after the entire core circumference is cut and rotation of the core has stopped. The end piece is thereby secured on the carrying member, and swinging or movement of the end piece while resting on the carrying member is prevented.

In a second aspect of the teachings herein, there is provided a core end piece collector for handling cut off core end pieces. The collector is configured for use during processing of tubular cores with a hollow centre portion, and the core end piece collector comprises a carrying member and a catcher which is arranged on the carrying member. The catcher protrudes from the carrying member at an angle in relation to the longitudinal direction of the carrying member, and the core end piece collector further comprises means for moving at least the carrying member in relation to the core. The collector secures and collects the end pieces of the cores which are being processed and enables reduction of the end piece size.

In one embodiment, the catcher protrudes essentially perpendicular in relation to the longitudinal direction of the carrying member to a height measured from the surface of the carrying member which is equal to or less than the wall thickness of the processed core.

The collector may further comprise a clamping element arranged on the carrying member inside of the catcher. The clamping element is reciprocally moveable towards and away from the catcher, respectively. The catcher clamps the end piece such that it is secured on the carrying member.

In another embodiment, the collector further comprises a roller which is arranged at the free end of the carrying member, and which is configured to abut against the inner surface of the core, and wherein the roller is rotatable in relation to the carrying member. The roller prevents the carrying member and/or the catcher from damaging the core when it is being cut.

In one embodiment, a protrusion is arranged on at least a portion of the circumference of the carrying member, the protrusion having a gradually increasing height towards the roller such that an end piece can slide of the carrying member. The protrusion prevents the end piece from catching on the roller when sliding off the carrying member.

The means for moving at least the carrying member and the catcher of the collector may comprise electrical motors and/or pneumatic cylinders. Electrical motors and/or pneumatic cylinders are commonly used components for achieving movements of various components and may provide efficient movement of the collector.

In an embodiment of the teachings herein, the collector further comprises a controller which is configured to control the movements of the collector and to be connected to a core processing apparatus.

In a third aspect of the teachings herein, a core processing apparatus is provided. The apparatus is configured for cutting cores into sections, and it comprises (i) a cutting member for cutting off sections of the core, (ii) a core end piece collector according to the second aspect of the teachings herein, and (iii) a controller configured for controlling the movements of the processing apparatus and the core end piece collector. Thereby is a core processing apparatus provided which facilitates handling of core end pieces and makes it possible to reduce the size of the end pieces.

BRIEF DESCRIPTION OF THE DRAWINGS

Embodiments of the invention will be described in further detail in the following with reference to the accompanying schematic drawings which illustrate non-limiting examples on how the concept can be reduced into practice and in which.

DETAILED DESCRIPTION OF EMBODIMENTS

The disclosed embodiments will now be described more fully hereinafter with reference to the accompanying drawings, in which certain embodiments of the invention are shown. Like numbers refer to like elements throughout.

Figure 1A:
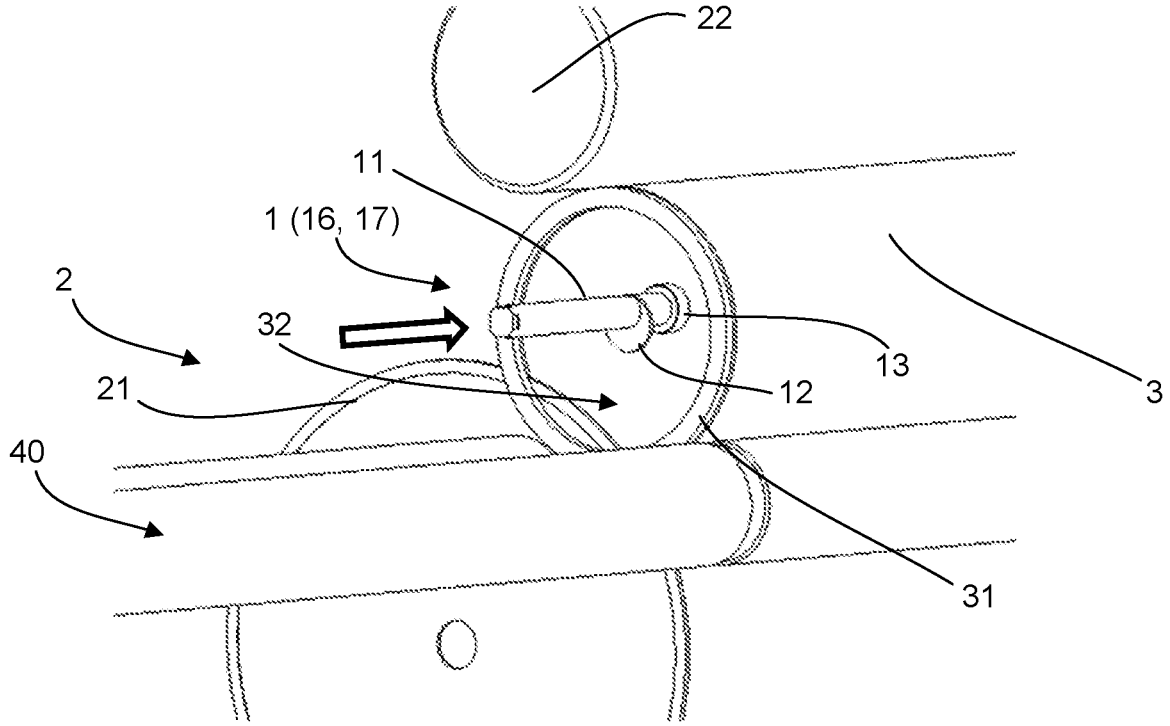
FIG. 1*a* shows—in a perspective view—a core end piece collector according to one embodiment as it is moved into a hollow centre portion of a core.
Figure 1B:
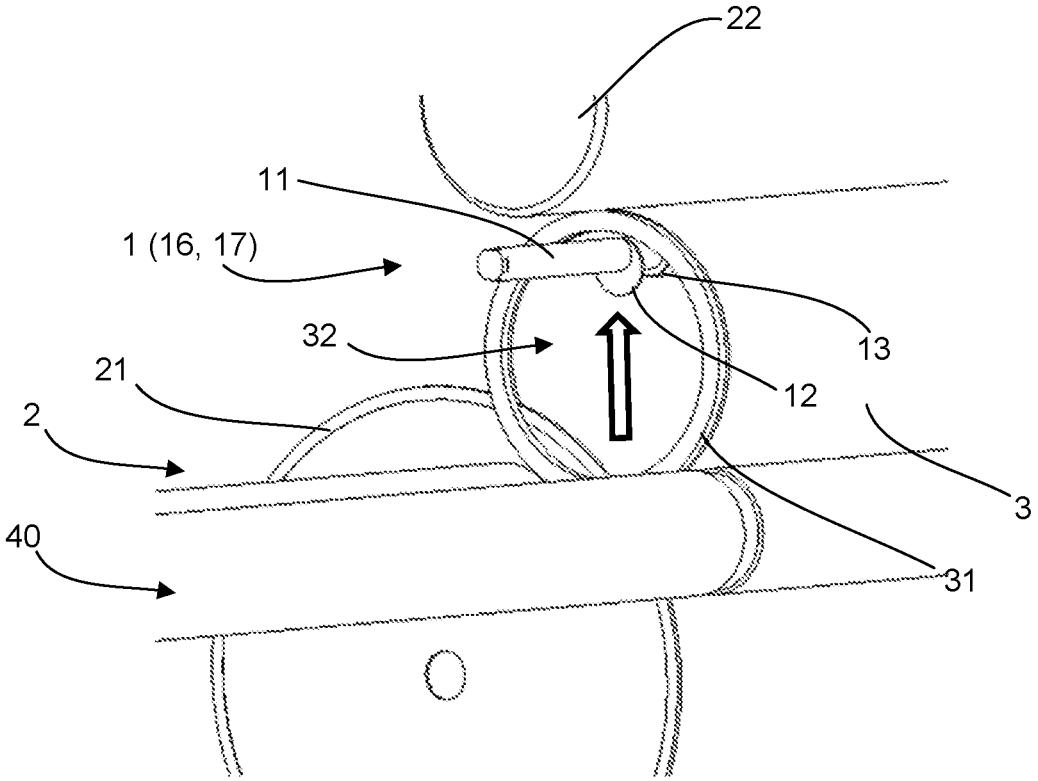
FIG. 1*b* shows—in a similar perspective view—how the core end piece collector of FIG. 1*a* is moved into the highest portion of the hollow centre portion of the core.
Figure 1C:
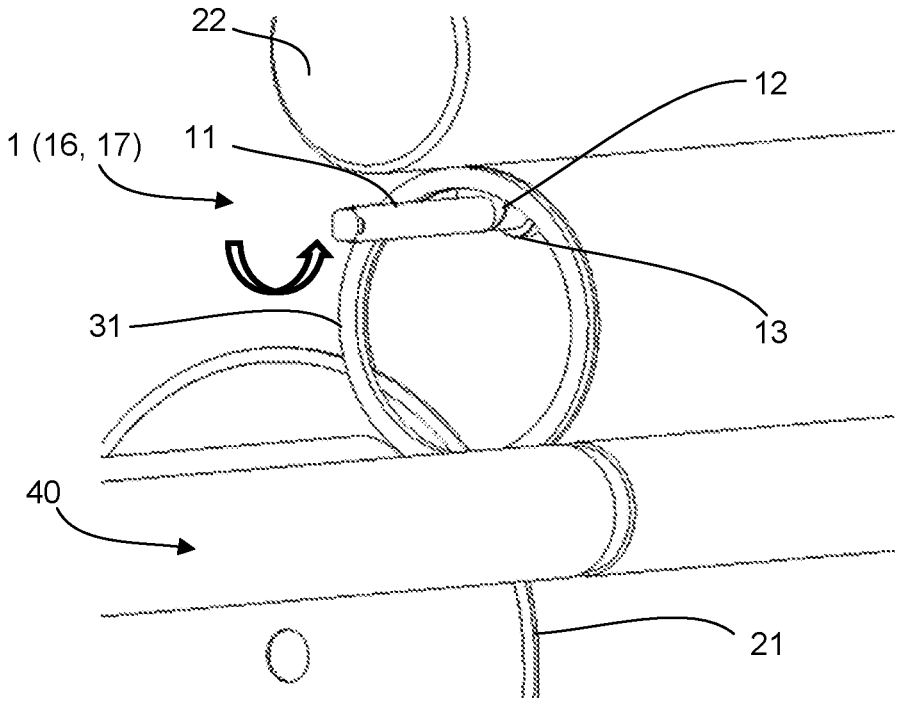
FIG. 1*c* shows—in a perspective view similar to FIGS. 1*a-b*—how a catcher included in the core end piece collector is inserted into a cut made by a cutting member.
Figure 1D:
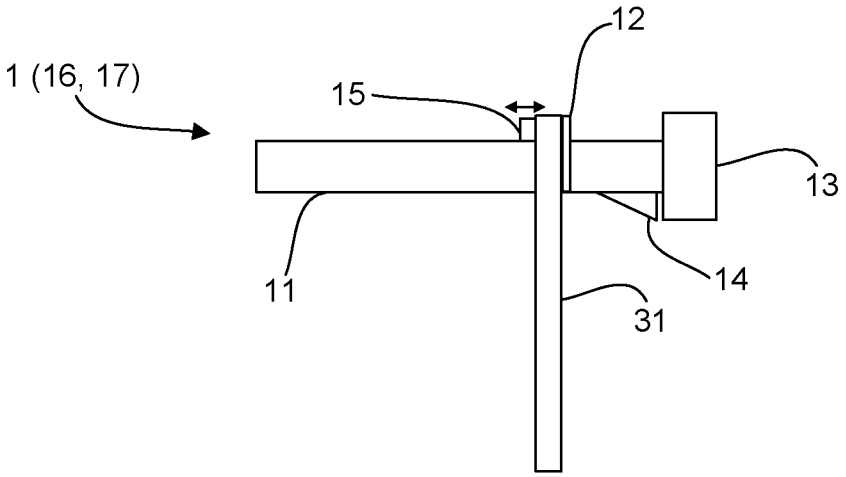
FIG. 1*d* shows—separately and in a side view—the core end piece collector carrying a core end piece.

With simultaneous reference to FIGS. 1*a* to 1*g*, a core end piece collector 1 is shown as it collects a core end piece 31 which is being cut from an elongated core 3. In FIG. 1*a*, the core 3 is seen as it is placed in a core processing apparatus 2 for cutting the core 3 into sections. The core 3 rests on rotatable cylinders 40 which support the core 3 as it is being cut. A cutting member 21 is provided, here illustrated as a circular saw blade, which preferably cuts transverse cuts in the core 3 in relation to the longitudinal direction or axis of the core 3. The apparatus 2 may also comprise a rotator 22 for rotating the core 3 when it is being cut. The core end piece collector 1 is adapted for collecting and stabilizing end pieces 31 when the core 3 is being processed in the core processing and core end piece trimming apparatus 2.

Core is a term for describing the load bearing structure onto which different sorts of materials suitable for winding is transported. The core 3 is preferably made of some sort of paper based material. However, it may also be made of for instance plastic materials, metals etc. Cores are sometimes reused and may therefore require processing, for instance cutting, to produce cores which fit the material that is to be wound onto it. When cutting cores 3 into smaller sections, it is inevitable that at least one of the end pieces of the core 3 needs to be handled when the desired core sections are removed. The teachings described herein facilitate handling of such end pieces, and enables the size of the end pieces to be reduced which in turn saves material and money.

Figure 2A:
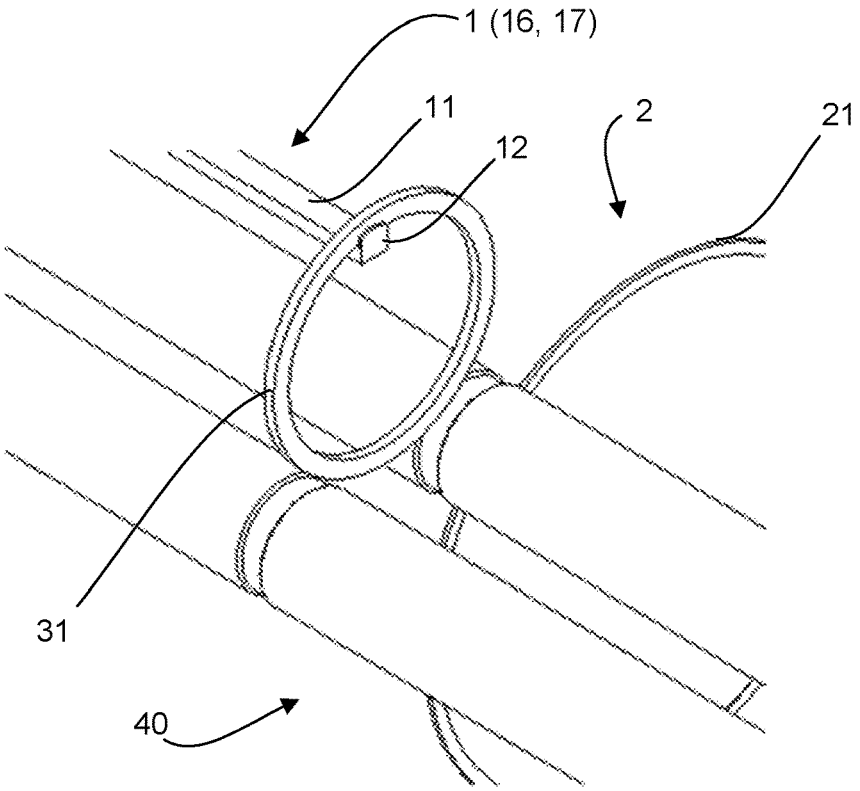
FIG. 2*a* shows—in a side view—how a core end piece collector releases an end piece in the end piece collecting position.
Figure 2B:
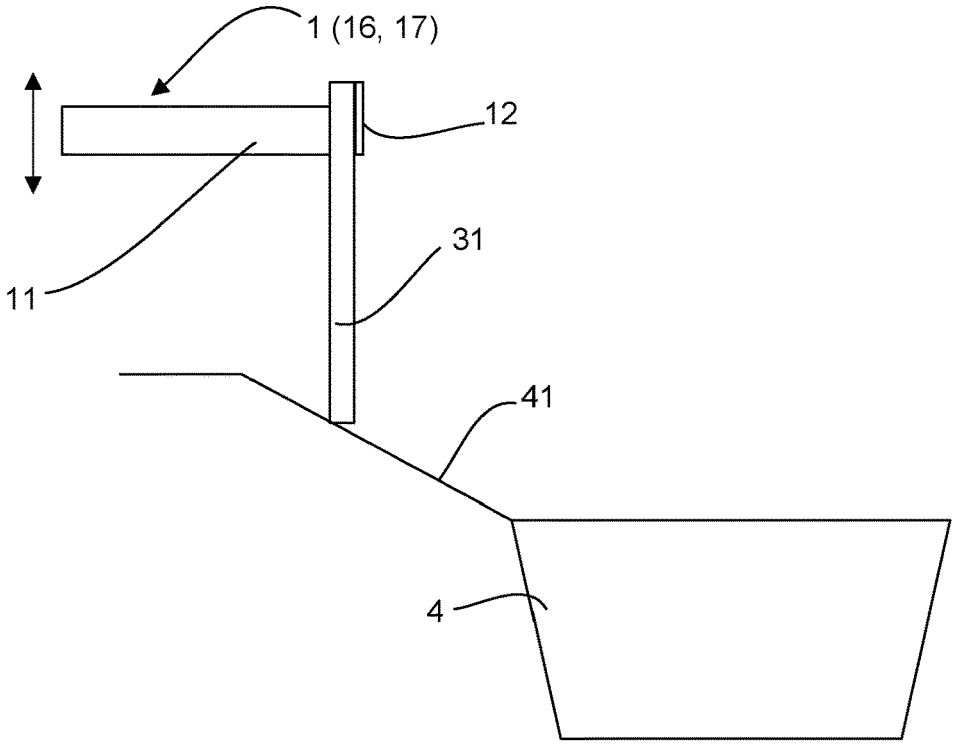
FIG. 2*b* shows the collector of FIG. 2*a* from another direction.

The core end piece collector 1 of the teachings herein comprises a carrying member 11 for carrying at least the majority of the weight of the end piece 31. The carrying member 11 is preferably an oblong beam of a suitable material such as metal, plastic, composite etc, which is arranged such that it is moveable in relation to the core processing apparatus 2 and to the core 3 being processed in the apparatus 2 which is included in a machine not described in detail here. The carrying member 11 has preferably have a cylindrical cross sectional shape or a rectangular cross sectional shape (as can be seen in FIGS. 2*a* and 2*b*); however other shapes are also possible. Furthermore, the carrying member 11 may be rotatable around its longitudinal axis.

The core end piece collector 1 further comprises a catcher 12 which is arranged on the carrying member 11. The catcher 12 protrudes from the carrying member 11 at an angle in relation to the longitudinal axis of the carrying member 11. Preferably, the catcher 12 protrudes in an essentially perpendicular direction in relation to the longitudinal axis of the carrying member 11 such that is possible to insert the catcher 12 into a cut in a core 3 when the longitudinal axis of the core 3 is essentially parallel with the carrying member 11. The catcher 12 preferably protrudes to a height from the surface of the carrying member 11 which is equal to or less than the wall thickness of the core 3, to ensure that the catcher 12 does not protrude past the outer peripheral surface of the core 3.

Preferably, the catcher 12 has an essentially circular shape, and the circular catcher 12 is preferably oriented in relation to the carrying member 11 such that it does not protrude from the peripheral surface of the carrying member 11 around the entire circumference of the carrying member 11. This facilitates removal of the end piece 31 from the carrying member 11 since by orienting, for instance by rotation, the carrying member 11 such that the part of the carrying member 11 where the catcher 12 does not protrude faces upwards, the end piece 31 is free to slide off the carrying member 11.

The carrying member 11 may further comprise a roller 13 arranged on the free end of the carrying member 11. The roller 13 is configured to come into contact with the interior surface of the core 3, thus preventing that the core end piece collector 1 damages the interior surface of the core 3 when the core 3 rolls during cutting. Preferably, the roller 13 is arranged on the carrying member 11 such that the rotational axis of the roller 13 is essentially parallel with the longitudinal axis of the core 3 when a portion of the carrying member 1 is moved into the core hollow portion 32.

The roller 13 may however obstruct the end piece 31 when it is removed from the carrying member 11. This can be avoided by the provision of a protrusion 14 which may be arranged on at least a portion of the circumference of the carrying member 11. The protrusion 14 has a gradually increasing height towards the roller 13 such that the end piece 31 can slide of the carrying member 11 and past the roller 13. Preferably, the protrusion 14 is ramp-shaped or wedge-shaped with the higher side being arranged in close proximity of the roller 13, and the protrusion 14 is preferably arranged on the side of the carrying member 11 opposite the catcher 12.

To further stabilize the end piece 31 when it is being collected, the core end piece collector 1 may comprise a clamping element 15 arranged on the carrying member 11 inside of the catcher 12. The clamping element 15 is reciprocally moveable towards and from the catcher 12 and can thereby clamp the end piece 31 so that it is held in place against the catcher 12 on the carrying member 11.

Figure 3:
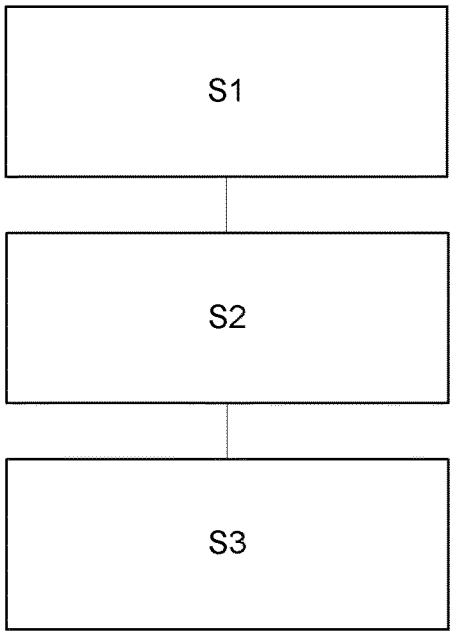
FIG. 3 illustrates a method for handling core end pieces according to one embodiment.

With simultaneous reference to FIGS. 1*a*-1*g* and to FIG. 3, the core end piece collector 1 is configured to move S1 at least a portion of the carrying member 11 inside the core centre portion 32, preferably such that the catcher 12 arranged on the carrying member 11 is aligned with a cutting plane P of a core cutting member 21. The core cutting member 21 is preferably a circular saw blade, configured to cut cores 3 into shorter sections. The catcher 12, which is adapted to fit in a cut (i.e. a gap between the core section which is being cut off and the remaining core) in the core 3 made by the cutting member 21, is thus placed in the vicinity of the cut which is being made or is to be made. The collector 1 is shown in this position in FIG. 1*b*, and it may be arranged to place the roller 13 in contact with the inner surface of the core 3 such that the roller 13 rolls against the surface when core 3 is being rotated. This provides an increased stability of the carrying member 11, and lifting of the core 3 by the contact from the collector 1 can be avoided by contacting the core 3 with the roller 13 on a portion of the inner surface of the core 3 which faces a rotator 22 used for rotating the core 3 while it is being cut. The contact force between the core 3 and the collector 1 may be measured and used as an indicator for determining when the carrying member 11 is in the correct position.

It is preferred that the location in the core 3 to which the collector 1 moves when collecting the end piece 31 is located in or in the vicinity of the highest portion inside the core 3 hollow portion 32. This is to prevent the end piece 31 from swinging on the carrying member 11 when it is lifted by the collector 1.

After the collector 1 has been moved inside the core 3, the catcher 12 is inserted S2 into a cut made by the core cutting member 21, which allows the catcher 12 to restrict the end piece 31 from falling of the carrying member 11. The collector 1 is shown in this position in FIG. 1*c*. The catcher 12 is preferably inserted S2 into the cut made by the cutting member 21 before the entire circumference of the core 3 is cut such that the collector 1 may catch the end piece 31 when it is cut free from the core 3. This is possible since many core processing apparatuses 3 comprise cutting members 21 which only need to be able to produce a cut which reaches through the wall of the core 3 which faces the cutting member 21 and it is by rotation of the core 3 that the entire circumference of the core 3 is cut. The rotator 22 is used to rotate the cores 3 which are being cut and is brought into contact with the peripheral surface of the core 3 when it is to be rotated.

The cutting member 21 needs to be able to move towards and from the core 3 to a certain degree to allow axial movement of the core 3 when positioning it for new cuts. The catcher 12 may, since the core 3 is being rotated, remain stationary until the core 3 is rotated such that the cut reaches and passes the position of the catcher 12, upon which it is inserted into the cut. The carrying member 11 may be rotated to bring the catcher 12 into the cut or moved in the plane P of the cut and thus avoiding the rotating motion of the carrying member 11. The catcher 12 may also be resilient such that it is compressed against the interior surface of the core 3 during rotation, and is inserted S2 into the cut by the spring force when the cut reaches the catcher 12.

When the entire core 3 has been cut and the rotation of the core 3 has stopped, the collector 1 may be arranged to clamp the end piece 31 using the clamping element 15.

Figure 1E:
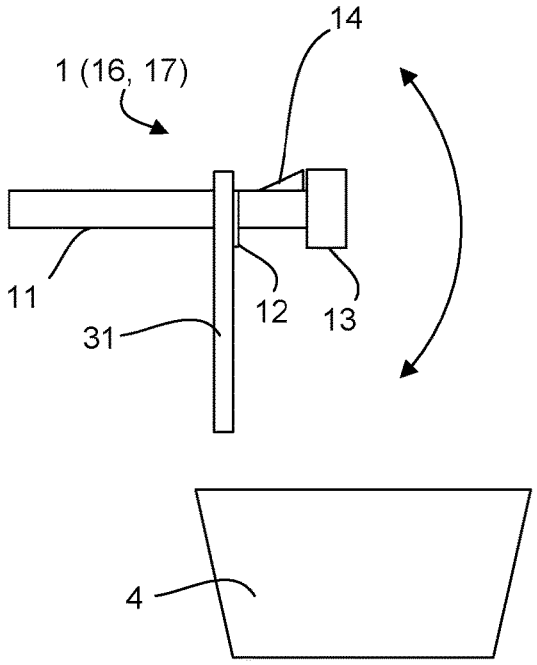
FIG. 1*e* shows—in a side view—how the core end piece collector of FIG. 1*d* releases an end piece in the end piece collecting position.
Figure 1F:
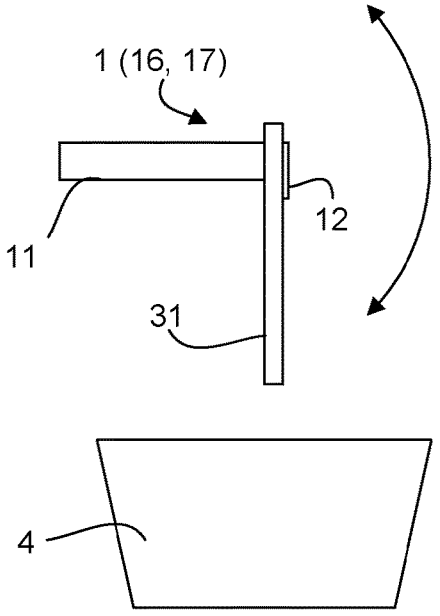
FIG. 1*f* shows—in a side view—a core end piece collector according to another embodiment as an end piece is released in the end piece collecting position.
Figure 1G:
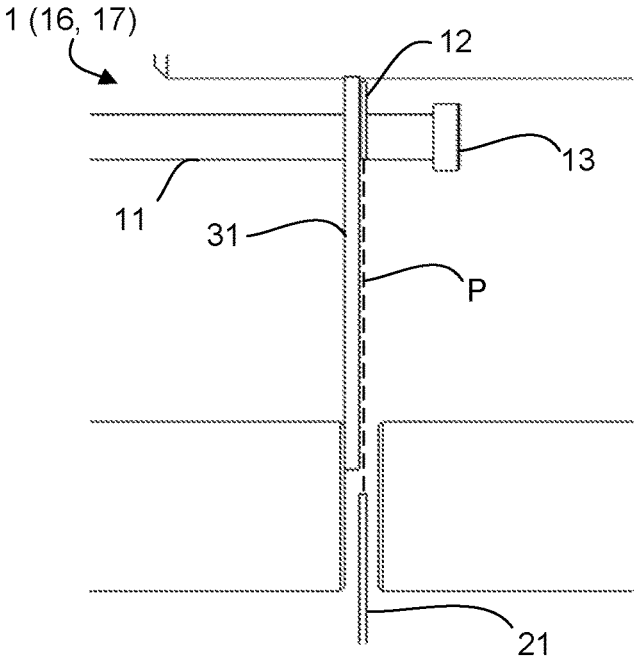
FIG. 1*g* shows—in a side view—the core end piece collector, whereby a cutting plane the cutting member is illustrated.

After the cut off core end piece 31 is collected or caught on the collector 1, it is placed S3 by the core end piece collector 1 in an end piece collection container or position 4. The collector 1 may collect several core end pieces 31 before placing them in the collection position 4 as this may be beneficial to increase the efficiency of the cutting process. After reaching the end piece collection position 4, releasing the end piece(s) may be achieved (as is illustrated in FIGS. 1*e* and 1*f*) by firstly rotating at least the carrying member 11 around the longitudinal axis of the carrying member 11 such that the catcher does not obstruct axial motion of the end piece 31 and then tilting at least the carrying member 11 such that the end piece 31 slides of. This can be further facilitated by the provision of the protrusion 14 on the carrying member 11 in the case where a roller 13 is arranged on the carrying member 11. In FIG. 1*g*, which is a side view of the collector 1, the cutting plane P is illustrated. The catcher 12 is in FIG. 1*g* brought into the position in which it is aligned with the cutting plane P and thus also with the cutting member 21.

In FIGS. 2*a* and 2*b*, the carrying member 11 has a rectangular cross section and is not configured to rotate as it inserts S2 the catcher 12 into the cut in the core 3. Since the collector 1 in the embodiment shown in FIGS. 2*a* and 2*b* does not comprise a roller, it is preferably not brought into contact with the core 3 when the core 3 is being rotated and cut. However, if the catcher 12 is resilient it is possible to bring the catcher 12 into contact with the interior surface of the core 3 during rotation of the core 3 as mentioned above. When the core 3 is rotated such that the cut has reached and/or passed the position of the catcher 12, the catcher 12 is inserted into the cut. When the core 3 is cut all the way round, the end piece 31 will be collected or caught by the carrying member 11 and the catcher 12. The collector 1 is thereafter configured to place the end piece 31 in the end piece collection position 4.

As the carrying member 11 of the collector 1 in the embodiment in FIGS. 2*a* and 2*b* is not configured to rotate, the carrying member 11 is instead lowered until the end piece 31 comes into contact with an uneven and/or leaning surface 41 which lifts the end piece 31 over the catcher 12 and allows it to fall into the end piece collecting position 4 in a controlled manner. The carrying member 11 may also be tilted before or during lowering to facilitate the release of the end piece 31. As can be seen in FIG. 2*a*, the catcher 12 protrudes from one side, preferably the side facing upwards, of the carrying member 11.

Figure 4:
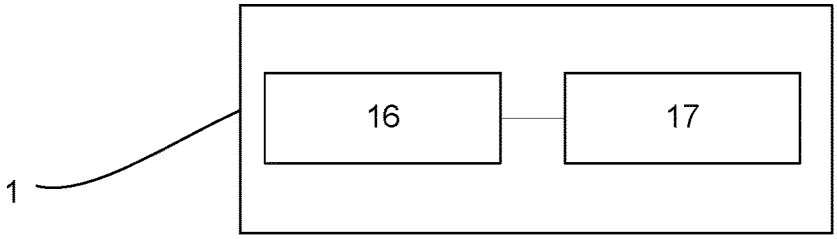
FIG. 4 shows a core end piece collector according to one embodiment.

In FIG. 4, a simplified representation of the core end piece collector 1 is presented in which functional components of the collector 1 are shown. The collector 1 comprises means 16 for moving the components of the collector 1. The moving means 16 may be electrical motors, pneumatic cylinders/pistons and/or any other suitable means for achieving movements of the collector 1. The collector 1 may further comprise a controller 17, such as a microprocessor capable of executing computer program code on a thereto connected memory. The controller 17 is configured for controlling the means 16 for moving the collector 1 and more specifically moving and orienting the carrying member 11.

Figure 5:
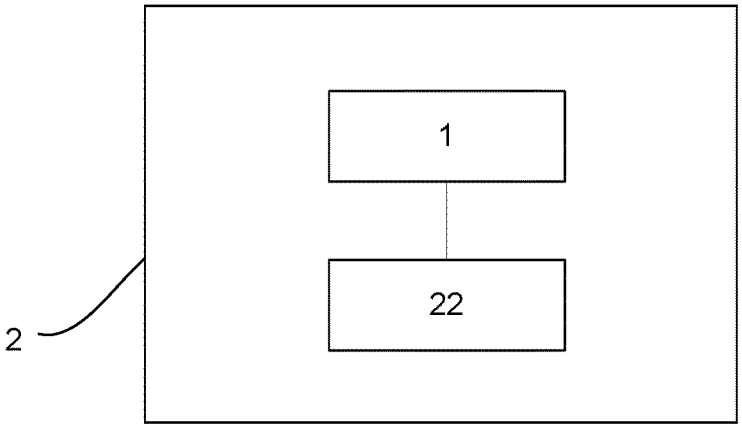
FIG. 5 shows a core processing apparatus according to one embodiment.

In FIG. 5, a core processing apparatus 2 is shown which comprises a controller 22 and a core end piece collector 1. The controller 22 is configured to control the core processing apparatus 2 and the thereto connected core end piece collector 1.

The described method for processing tubular cores 3 with hollow centre portions 32 comprises the following steps:

- moving S1 at least a portion of a carrying member 11 of a core end piece collector 1 inside the core centre portion 32,
- inserting S2 the catcher 12 into a transverse cut in the core 3 made by the core cutting member 21 whereby the catcher 12 restricts a cut off core end piece 31 from falling of the carrying member 11,
- catching the end piece 31 as it is cut off from the core 3, and
- placing S3, by means of the core end piece collector 1, the end piece 31 of the core in an end piece collection position 4.

It should be mentioned that the inventive concept is by no means limited to the embodiments described herein, and several modifications are feasible without departing from the scope of the invention as defined in the appended claims.

The invention claimed is:

1. A core processing apparatus configured for cutting tubular cores with a hollow centre portion into sections, said apparatus comprising:

(i) a rotational cutting member for cutting off sections of the core, wherein the rotational cutting member cuts through a wall of the core and makes a gap between an end piece of the core that is being cut off and the remaining core;

(ii) a core end piece collector configured to handle cut off end pieces during processing of the tubular cores, and comprising:

a carrying member having a longitudinal axis, and a catcher arranged on and protruding from one end of the carrying member in a radial direction of the carrying member; and (iii) a controller configured for controlling the movements of the apparatus and the core end piece collector, wherein the controller controls the core to be rotated during the cutting, the controller controls at least a portion of the carrying member to be inserted inside the core until the catcher is aligned with a cutting plane of the rotational cutting member, the controller further controls the catcher to be inserted into the gap made by the core cutting member before an entire circumference of the core is cut, for allowing the catcher to restrict the end piece from falling off the carrying member, wherein the longitudinal axis of the carrying member remains substantially parallel to a longitudinal axis of the core during the cutting of the core.

2. The core processing apparatus according to claim 1, wherein the catcher protrudes essentially perpendicular in relation to the longitudinal axis of said carrying member to a height measured from the surface of the carrying member which is equal to or less than a wall thickness of the processed core.

3. The core processing apparatus according to claim 1, wherein the collector further comprises a clamping element arranged on the carrying member inside of the catcher and wherein said clamping element is reciprocally moveable towards and away from the catcher, respectively.

4. The core processing apparatus according to claim 1, wherein the collector further comprises a roller arranged at the free end of the carrying member, the roller being configured to abut against the inner surface of the core, and wherein the roller is rotatable in relation to the carrying member.

5. The core processing apparatus according to claim 4, wherein a protrusion is arranged on at least a portion of the circumference of the carrying member, the protrusion having a gradually increasing height towards the roller such that the end piece is capable of sliding off the carrying member.

6. The core processing apparatus according to claim 1, wherein at least the carrying member and the catcher of the collector are moved in relation to the core by electrical motors and/or pneumatic cylinders.

7. The core processing apparatus according to claim 1, the collector further comprises a controller for controlling the movements of the collector and wherein said controller is configured to be connected to a core processing apparatus.

* * * * *